US006405382B2

(12) United States Patent
Shida

(10) Patent No.: US 6,405,382 B2
(45) Date of Patent: Jun. 18, 2002

(54) HELMET

(75) Inventor: Masayuki Shida, Tokyo (JP)

(73) Assignee: Shoei, Co., Ltd., Taito-ku (JP)

( * ) Notice: Subject to any disclaimer, the term of this patent is extended or adjusted under 35 U.S.C. 154(b) by 0 days.

(21) Appl. No.: 09/846,595

(22) Filed: May 1, 2001

(30) Foreign Application Priority Data

May 9, 2000 (JP) ..... 2000-135776

(51) Int. Cl.[7] ..... A42C 5/04

(52) U.S. Cl. ..... 2/171.3; 2/411; 2/424; 2/410

(58) Field of Search ..... 2/171.3, 424, 410, 2/414, 411, 425, 422

(56) References Cited

U.S. PATENT DOCUMENTS 4,704,746 A * 11/1987 Nava ..... 2/171.3
5,093,938 A * 3/1992 Kamata ..... 2/171.3
5,388,277 A * 2/1995 Taniuchi ..... 2/422
5,394,566 A * 3/1995 Hong ..... 2/171.3
5,867,840 A * 2/1999 Hirosawa et al. ..... 2/414
6,105,172 A * 8/2000 Shida ..... 2/171.3

FOREIGN PATENT DOCUMENTS

| | | | |
|---|---|---|---|
| DE | 3233467 | * | 3/1984 |
| DE | 3344706 | * | 6/1985 |
| GB | 2186194 | * | 8/1987 |
| JP | 63-9542 | | 3/1988 |
| JP | 2-10432 | | 1/1990 |
| JP | 2-87029 | | 7/1990 |

* cited by examiner

*Primary Examiner*—Rodney M. Lindsey
(74) *Attorney, Agent, or Firm*—Jones, Day, Reavis & Pogue

(57) ABSTRACT

A helmet with an air supply/exhaust hole serving as a hole to be shared by an air supply hole portion for an air supply path for introducing air outside an outer shell into a head protecting body, and an exhaust hole portion for an exhaust path for exhausting air in the head protecting body to an outside of the outer shell. According to this helmet, a predetermined region in the head protecting body can be ventilated well. The air supply hole portion for the air supply path and the exhaust hole portion for the exhaust path can be formed in the outer shell easily. An outer shell with a high strength can be obtained easily. Design limitations on the outer shell can be reduced.

18 Claims, 4 Drawing Sheets

HELMET

TECHNICAL FIELD

The present invention relates to a helmet having a head protecting body with an outer shell, in which an air supply path for introducing air outside the outer shell into the head protecting body is formed in the head protecting body, and an exhaust path for exhausting air in the head protecting body outside the outer shell is formed in the head protecting body apart from the air supply path.

BACKGROUND OF THE INVENTION

Conventionally, as a helmet to be worn by the head of a helmet wearer (to be referred to as a "wearer" hereinafter) such as the rider of a motor cycle, a full-face-type helmet is known. Usually, the cap-shaped head protecting body of such a full-face-type helmet has a chin ventilator mechanism under a window opening formed to oppose the face of the wearer. The chin ventilator mechanism has a chin air supply path extending from an air supply port or air supply notch formed in the chin region (i.e., a region opposing the chin of the wearer) of the outer shell. In addition to the chin air supply path, a breath guard is attached to the head protecting body between the mouth of the wearer and a shield plate in order to prevent the shield plate from being fogged by the breath exhaled by the wearer.

In such a conventional helmet, outer air is introduced, near the lower end of the inner surface of the shield plate, into the head protecting body through the chin air supply path. The introduced outer air is let to flow upward along the inner surface of the shield plate, and the breath guard prevents the breath exhaled by the wearer from being directly directed toward the shield plate, thereby preventing fogging of the shield plate.

In this conventional helmet, when the humidity is very high due to a rainfall, the shield plate is inevitably fogged due to the breath exhaled by the wearer, and anti-fogging of the shield plate cannot be performed well. Therefore, as a countermeasure, in the conventional helmet, a pair of right and left exhaust holes may be formed in the chin region of an impact absorbing liner. A pair of right and left exhaust holes may be formed in a corresponding chin region of an outer liner, and a pair of right and left chin exhaust paths may be formed to extend from the liner-side exhaust holes to the outer-shell-side exhaust holes.

In the conventional helmet with the above arrangement, the air supply hole for the chin air supply path must be formed at substantially the central portion of the chin region of the outer shell, and the pair of right and left air supply holes for the pair of right and left chin air supply paths must be formed on the right and left sides of the chin region of the outer shell. This requires a complicated process of forming the air supply hole and exhaust holes in the outer shell, and it is cumbersome and time-consuming to obtain an outer shell with a high strength. Also, the outer shell has a large design limitation.

SUMMARY OF THE INVENTION

The present invention is directed to correcting the drawbacks described above of the conventional helmet effectively with a comparatively simple arrangement.

It is, therefore, the main object of the present invention to provide a helmet in which an air supply path for introducing air outside an outer shell into a head protecting body and an exhaust path for exhausting air in the head protecting body outside the outer shell are formed in the head protecting body apart from and adjacent to each other, so that air is supplied to and exhausted from a predetermined region in the head protecting body simultaneously, thereby ventilating the predetermined area well.

It is another object of the present invention to provide a helmet in which since an air supply hole for an air supply path and an exhaust hole for an exhaust path need not be separately formed in an outer shell independently of each other, the process of forming both an air supply hole portion for an air supply path and an exhaust hole portion for an exhaust path in the outer shell can be comparatively simple, an outer shell with a high strength can be obtained comparatively easily, and design limitation on the outer shell can be made comparatively small.

It is still another object of the present invention to provide a helmet in which an air supply path can have a comparatively simple structure and outer air can flow in the air supply path in a good state.

It is still another object of the present invention to provide a helmet in which an air exhaust path can have a comparatively simple structure.

It is still another object of the present invention to provide a helmet in which since air is supplied to and exhausted from the chin region in the head protecting body simultaneously, the chin region can be ventilated well, so that even when the humidity is very high due to a rainfall, the shield plate can be effectively prevented from being fogged by the breath exhaled by the wearer.

It is still another object of the present invention to provide a helmet in which air in the head protecting body can be let to flow out effectively from the air outlet port of a head air path, so that the interior of the head protecting body can be ventilated better.

The present invention relates to a helmet comprising a head protecting body with an outer shell, wherein an air supply path for introducing air outside the outer shell into the head protecting body is formed in the head protecting body, an exhaust path for exhausting air in the head protecting body outside the outer shell is formed in the head protecting body apart from the air supply path, and an air supply/exhaust hole serving as a hole to be shared by an air supply hole portion for the air supply path and an exhaust hole portion for the exhaust path is formed in the outer shell.

According to the first aspect of the present invention, one half of the air supply/exhaust hole, which is on a central side of the helmet in a horizontal direction, forms the air supply hole portion for the air supply path, and the other half of the air supply/exhaust hole, which is opposite to the central side of the helmet in the horizontal direction, forms the exhaust hole portion for the exhaust path.

The present invention and the first aspect described have, according to the second aspect, an air supply path main body which forms the air supply path together with the air supply hole portion of the air supply/exhaust hole, and an air supply path forming member used for forming the air supply path main body is disposed on an inner surface of a chin region of the outer shell.

In the second aspect of the present invention, according to the third aspect, the air supply path forming member has at least three (more preferably at least four) straightening air supply paths.

In the second and third aspects of the present invention, according to the fourth aspect, an air supply port forming member with an inner air supply port forming portion is arranged between the outer shell and the air supply path forming member.

In the fourth aspect of the present invention, according to the fifth aspect, a shutter member for opening/closing a ventilation port of the inner air supply port forming portion is provided to the air supply port forming member.

The second to fifth aspects have, according to the sixth aspect, an exhaust path main body for constituting the exhaust path together with the exhaust hole portion of the air supply/exhaust hole, and an impact absorbing liner arranged inside the outer shell, and the exhaust path main body comprises a recess formed in an outer surface of the impact absorbing liner, an aperture formed in the impact absorbing liner to be continuous to the recess, and a partitioning plate of the air supply path forming member.

In the sixth aspect, according to the seventh aspect, a bottom surface of the recess forms a slant surface slanting backward toward that side of the helmet which is opposite to a central longitudinal section line side, and the slant surface has a slant angle within a range of 0.5° to 5° (more preferably 1° to 3°).

In the sixth and seventh aspects of the present invention, according to the eighth aspect, at least part of that portion of an outer surface of the partitioning plate, which forms the exhaust path main body, forms a slant surface slanting forward toward that side of the helmet which is opposite to the central longitudinal section line side, and the slant surface has a slant angle within a range of 0.5° to 5° (more preferably 1° to 3°).

In the first to eighth aspects of the present invention, according to the ninth aspect, the air supply/exhaust hole comprises a pair of left and right air supply/exhaust holes in the chin region of the outer shell, the air supply path is formed at a substantially central portion in a horizontal direction of said chin region of said head protecting body, the exhaust path comprises a pair of left and right exhaust paths on left and right portions of the chin region of the head protecting body, those halves of the pair of left and right air supply/exhaust holes, which are on the central side in the horizontal direction, form air supply hole portions for the air supply path, and those halves of the pair of left and right air supply/exhaust hole, which are opposite to the central side in the horizontal direction, form exhaust hole portions for the pair of left and right exhaust paths.

In the ninth aspect of the present invention, according to the 10th aspect, the air supply path branches into two branches from an end point to a start point thereof.

In the sixth to 10th aspects of the present invention, according to the 11th aspect, a fitting opening is formed at a center of a lower portion of the air supply path forming member by notching upward from a lower end of the air supply path forming member, and a fitting projection is formed on the impact absorbing liner, the fitting projection being fitted in the fitting opening.

In the ninth to 11th aspects of the present invention, according the 12th aspect, an air outlet port which forms an end point of a head air path is formed in a lower end face of a rear portion of the head protecting body, and a narrow or constricted portion is formed in a rear portion of the outer shell.

In the 12th aspect of the present invention, according to the 13th aspect, a slant angle of the narrow or constricted portion near a lower end of the rear portion of the outer shell is in a range of 20° to 40° (more preferably 25° to 35°) on a center line in a right-to-left direction of the outer shell.

The above and other objects, features and advantages of this invention will become readily apparent from the following detailed description thereof which is to be read in connection with the accompanying drawings.

DETAILED DESCRIPTION OF THE INVENTION

An embodiment in which the present invention is applied to a full-face-type helmet will be described with reference to the accompanying drawings.

(1) Description on Entire Helmet

Figure 1:
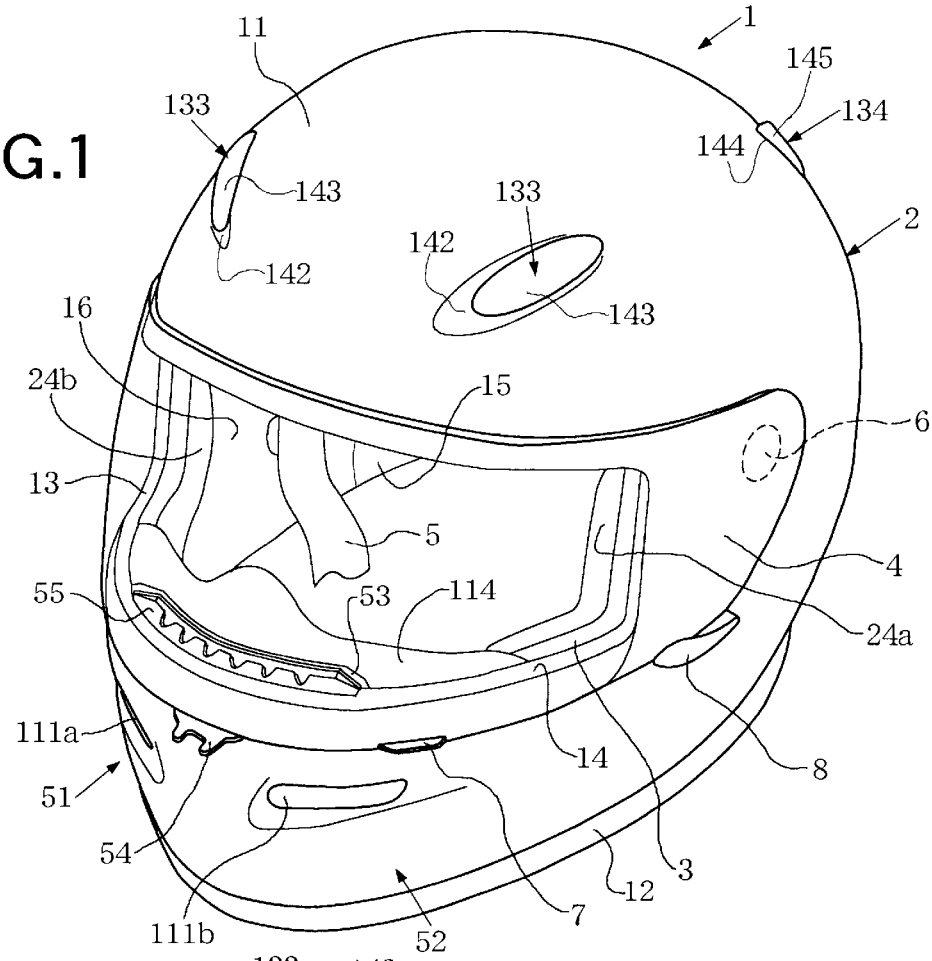
FIG. 1 is an overall perspective view of a helmet in an embodiment in which the present invention is applied to a full-face-type helmet.
Figure 2:
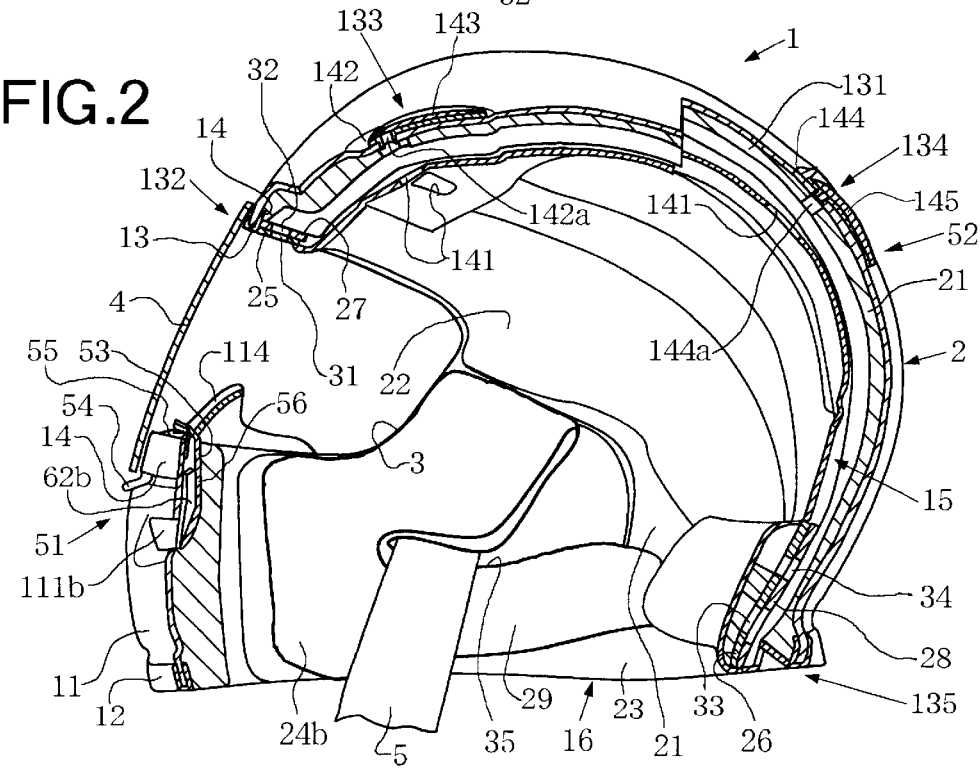
FIG. 2 is a longitudinal sectional view of the helmet shown in FIG. 1.

As shown in FIGS. 1 and 2, a full-face-type helmet 1 is made up of a full-face-type head protecting cap body 2 to be worn on the head of a wearer, a shield plate 4 capable of opening/closing a window opening 3 formed in the front surface of the head protecting body 2 to oppose the portion (i.e., the face) between the forehead and chin of the wearer, and a pair of right and left chin straps 5 attached to the inside of the head protecting body 2. As has been known, the shield plate 4 is made of a transparent or translucent hard material such as polycarbonate or another hard synthetic resin. The shield plate 4 is pivotally attached to the head protecting body 2 with a pair of right and left attaching screws 6. The shield plate 4 closes the window opening 3 at the backward pivoting position shown in FIGS. 1 and 2, and opens the window opening 3 at the forward pivoting position at which the shield plate 4 has pivoted upward from the backward pivoting position. At the intermediate position between these positions, the shield plate 4 can partly open the window opening 3. In FIG. 1, a tap 7 is formed on the shield plate 4 and is held by the wearer with his fingers when the wearer is to pivot upward and downward the shield plate 4. An operating lever 8 is formed on the head protecting body 2 and is operated by the wearer when the wearer is to slightly pivot upward the shield plate 4 located at the backward pivoting position.

As shown in FIGS. 1 and 2, the head protecting body 2 is made up of a full-face-type outer shell 11 which forms the circumferential wall of the head protecting body 2, a lower rim member 12 having a substantially U-shaped cross-section and fixed to the outer shell 11 throughout the lower end of the outer shell 11 with an adhesive or the like, a rim member 14 for a window opening, which has a substantially E-shaped cross-section and is fixed, with an adhesive or the like, to the outer shell 11 throughout the periphery of an window opening 13 formed in the outer shell 11 to form the window opening 3 of the head protecting body 2, a backing member 15 for the head, which is fixed to the outer shell 11 with an adhesive or the like in contact with the inner surface of the outer shell 11 in a front head region, a top head region, right and left side head regions and a back head region respectively corresponding to the front part, top part, right and left parts and back part of the head of the wearer, and a backing member 16 for the chin and cheek, which is fixed to the outer shell 11 with an adhesive or the like in contact with the inner surface of the outer shell 11 in chin and cheek regions respectively corresponding to the chin and cheeks of the wearer.

As is conventionally known, the outer shell 11 can be made of a composite material formed by lining the inner surface of a strong shell body made of a hard synthetic resin, e.g., FRP, with a flexible sheet such as an nonwoven fabric. As is conventionally known, the lower rim member 12 can be made of a soft synthetic resin such as foamed vinyl chloride or synthetic rubber. As is conventionally known, the rim member 14 can be made of an elastic material with high flexibility such as synthetic rubber.

Figure 6:
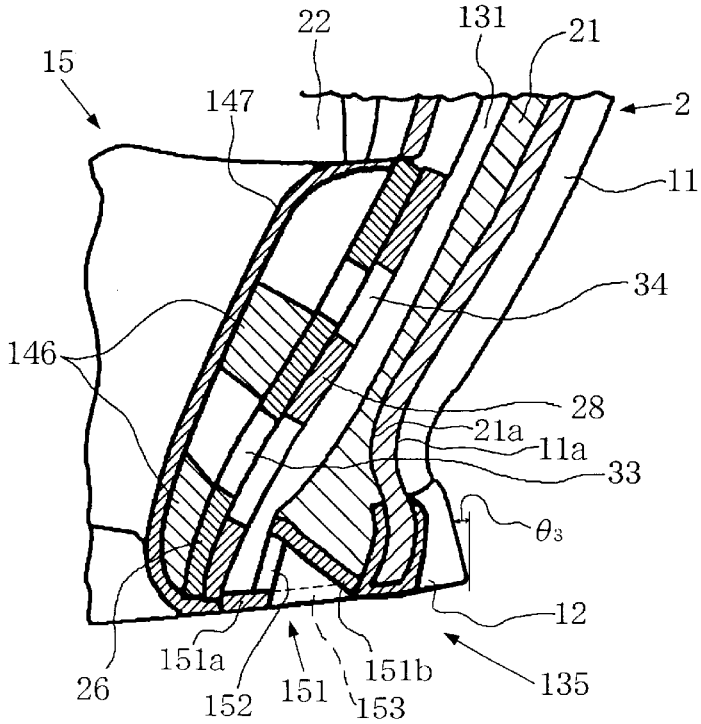
FIG. 6 is an enlarged longitudinal sectional view of the nape ventilator portion of the head ventilator mechanism shown in FIG. 2.

As is shown in FIGS. 2 and 6, the backing member 15 is constituted by an impact-on-the-head absorbing liner 21 and a breathing backing cover 22 for the head attached to the impact-on-the-head absorbing liner 21 so as to cover almost its entire inner surface. The backing member 16 is constituted by an impact-on-the-chin-and-cheek absorbing liner 23 and a pair of left and right blockish inside pads 24*a* and 24*b* for the cheeks which are attached to the impact-on-the-chin-and-cheek absorbing liner 23 in contact with the inner surface of the impact-on-the-chin-and-cheek absorbing liner 23 in left and right cheek regions corresponding to the left and right cheeks of the wearer.

As is conventionally known, the body portion of each of the impact-on-the-head absorbing liner 21 and impact-on-the-chin-and-cheek absorbing liner 23 can be made of a material with appropriate rigidity and appropriate plasticity such as polystyrene foam or another synthetic resin. As is conventionally known, the body portion of the backing cover 22 can be made of a combination of woven fabric and porous nonwoven fabric formed by laminating layers, each made of an elastic material with high flexibility such as urethane foam or another synthetic resin, on the surface (i.e., the outer surface) opposing the impact-on-the-head absorbing liner 21, or two side surfaces.

As shown in FIGS. 2 and 6, a front-side engaged member 25 and rear-side engaged member 26 are respectively attached to the front and rear end portions of the body portion of the backing cover 22 with a sewing thread, a tape, an adhesive or the like. A front-side engaging member 27 and rear-side engaging member 28 are respectively attached to the front and rear end portions of the body portion of the impact-on-the-head absorbing liner 21 by fixing with rivets and washers or the like, or with an adhesive, a tape or the like to substantially oppose the front- and rear-side engaged members 25 and 26. A pair of left and right engaged studs (not shown) respectively formed on the front- and rear-side engaged members 25 and 26 on the backing cover 22 side are press-fitted in a pair of left and right engaging apertures (not shown) respectively formed in the front- and rear-side engaging members 27 and 28 on the impact-on-the-head absorbing liner 21 through projection-recess engagement, thereby detachably attaching the backing cover 22 to the impact-on-the-head absorbing liner 21.

As is conventionally known, the front- and rear-side engaged members 25 and 26 of the backing cover 22 and the front- and rear-side engaging members 27 and 28 on the impact-on-the-head absorbing liner 21 can be made of a flexible synthetic resin such as polyethylene. In FIGS. 2 and 6, appropriate numbers of ventilation openings 31 and 32, and 33 and 34 are formed in the front-side engaged and engaging members 25 and 27 and the rear-side engaged and engaging members 26 and 28, respectively.

The pair of left and right blockish inside pads 24*a* and 24*b* for the cheeks are symmetrical. Thus, the blockish inside pad 24*b* for the right cheek will be described in detail with reference to FIG. 2, and a detailed description on the blockish inside pad 24*a* for the left cheek will be omitted.

As shown in FIG. 2, the blockish inside pad 24*b* for the right cheek has a notch 35 to exclude an ear region corresponding to the right ear part of the wearer. Hence, the blockish inside pad 24*b* has a shape corresponding to the right cheek part and its vicinity (excluding the right ear part) of the wearer. The left chin strap 5 is inserted in the notch 35. As is conventionally known, the blockish inside pad 24*b* may be made up of a thick platelike cushion member (not shown) formed of one or a plurality of flexible, elastic members of material such as urethane foam or another synthetic resin, and a bag-like member 29 covering the cushion member substantially entirely like a bag.

Figure 5A:
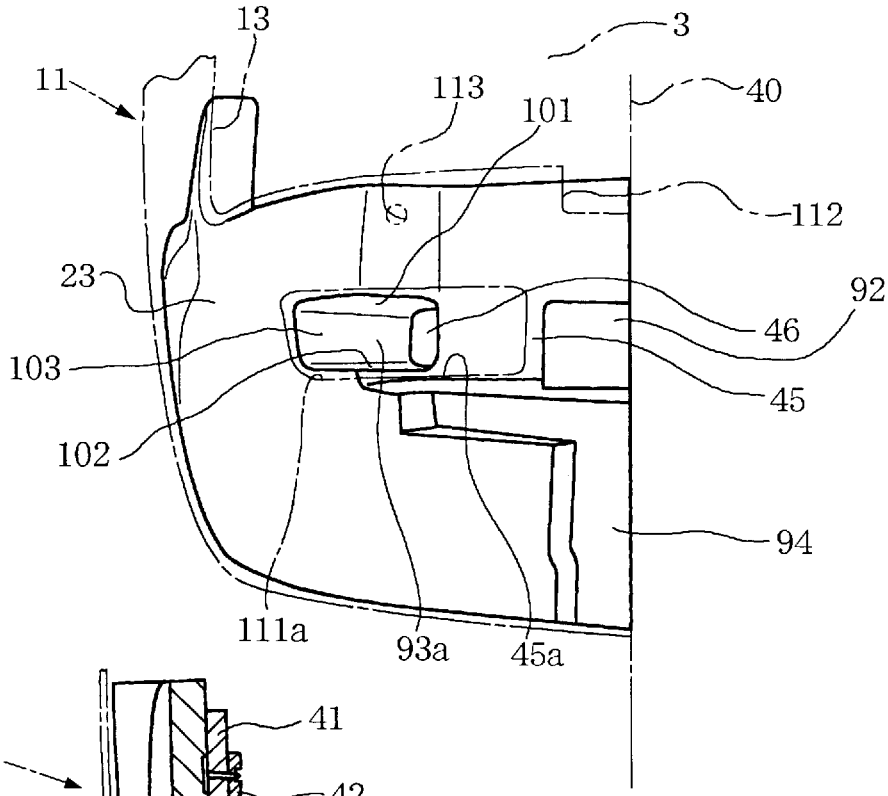
FIG. 5A is a front view of the left half of the impact-on-the-chin-and-cheek absorbing liner shown in FIG. 3 which is longitudinally taken at the center.
Figure 5B:
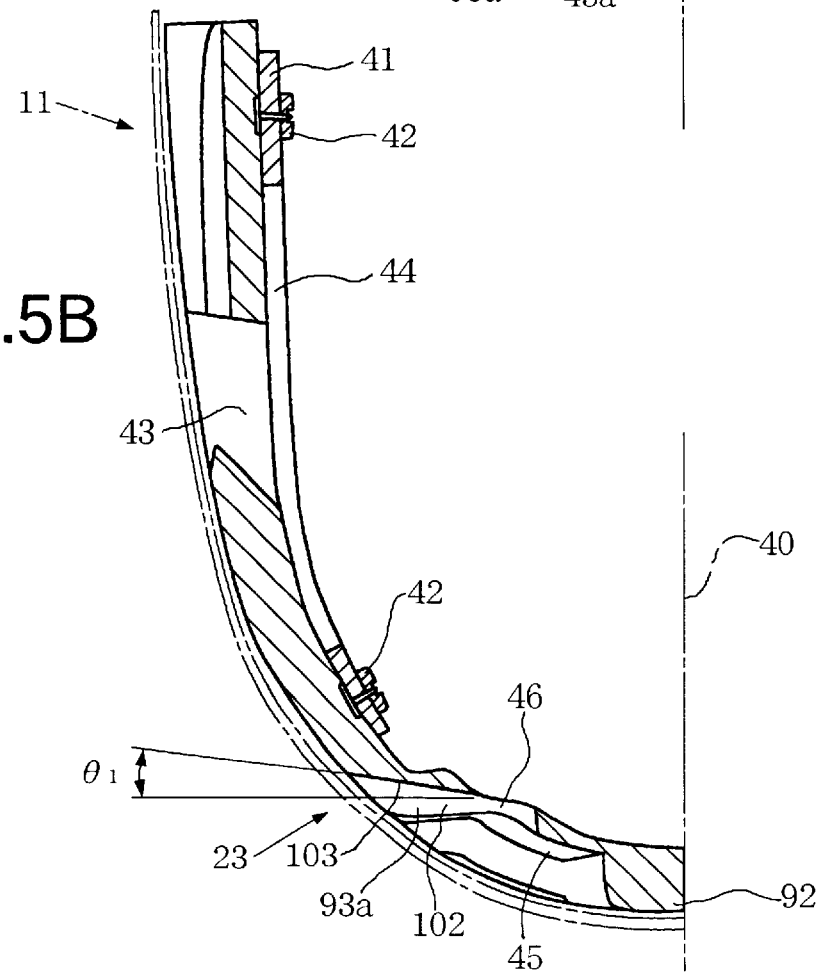
FIG. 5B is a cross-sectional view of the left half shown in FIG. 5A.

FIG. 5A is a front view of the left half of the impact-on-the-chin-and-cheek absorbing liner 23 with a symmetric shape (i.e., an axi-symmetrical shape), which is longitudinally taken at a central longitudinal section line 40 of the full-face-type helmet 1, and FIG. 5B is a cross-sectional view of the same. As shown in FIG. 5B, a pair of right and left support members 41 are attached to the inner surface of the main body portion of the impact-on-the-chin-and-cheek absorbing liner 23 with an adhesive or the like. An appropriate number of female portions (i.e., female hooks) 42 of round hooks which form engaging holes are attached to the support members 41. An appropriate number of male portions (i.e., male hooks) of round hooks which form engaging projections are attached to the outer surface of the blockish inside pad 24*b*. The male hooks (not shown) are press-fitted in the female hooks 42 by recess-projection engagement, thereby detachably attaching the blockish inside pad 24*b* for the cheek to the impact-on-the-chin-and-cheek absorbing liner 23.

Referring to FIG. 5B, openings 43 and 44 are formed in the body portion of the impact absorbing liner 23 and the support members 41 so the chin straps 5 are inserted through them. In FIGS. 5A and 5B, a central or front recess 45 is formed in almost the central portion of the front surface of the body portion of the impact-on-the-chin-and-cheek absorbing liner 23, and an exhaust hole 46 is formed on the liner 23 side to be continuous to the front recess 45. The front recess 45 and the exhaust holes 46 on the liner 23 side will be described later in detail.

The head protecting body 2 has a chin ventilator mechanism 51 corresponding to the chin region of the backing member 16 for the chin and cheek, and a head ventilator mechanism 52 corresponding to the backing member 15 for the head. The chin ventilator mechanism 51 and head ventilator mechanism 52 will be described hereinafter separately.

(2) Description on Chin Ventilator Mechanism 51

Figure 3:
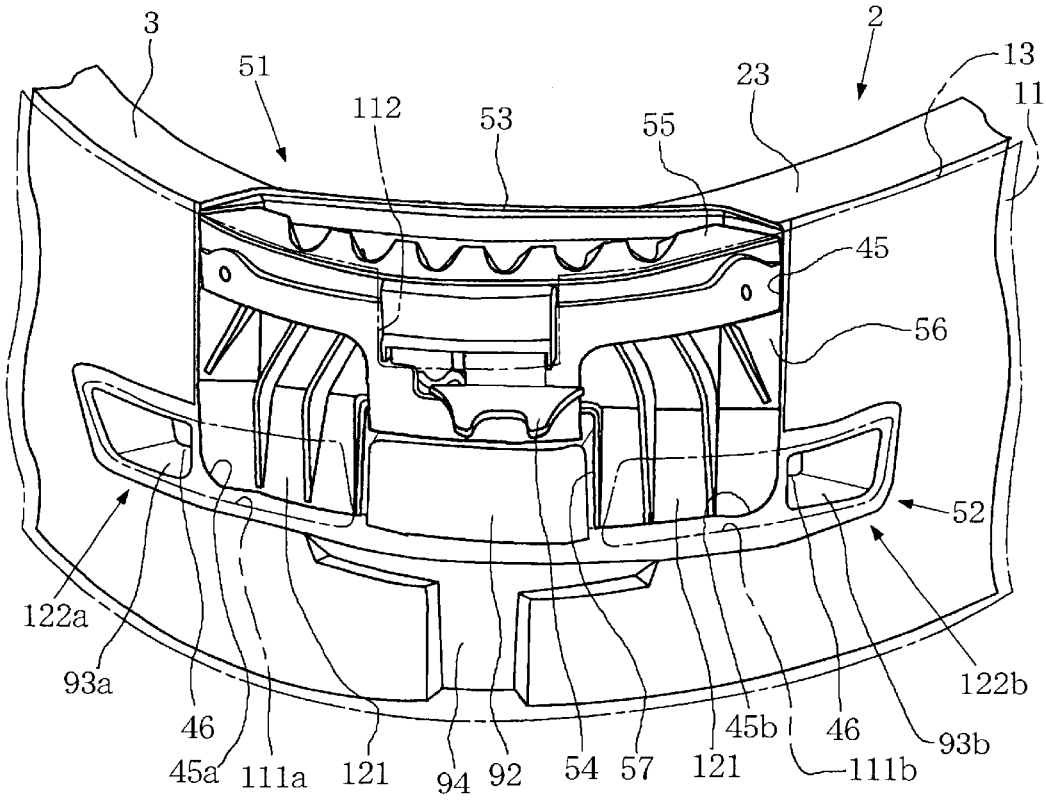
FIG. 3 is a perspective view of the chin ventilator mechanism of the helmet shown in FIG. 1.
Figure 4:
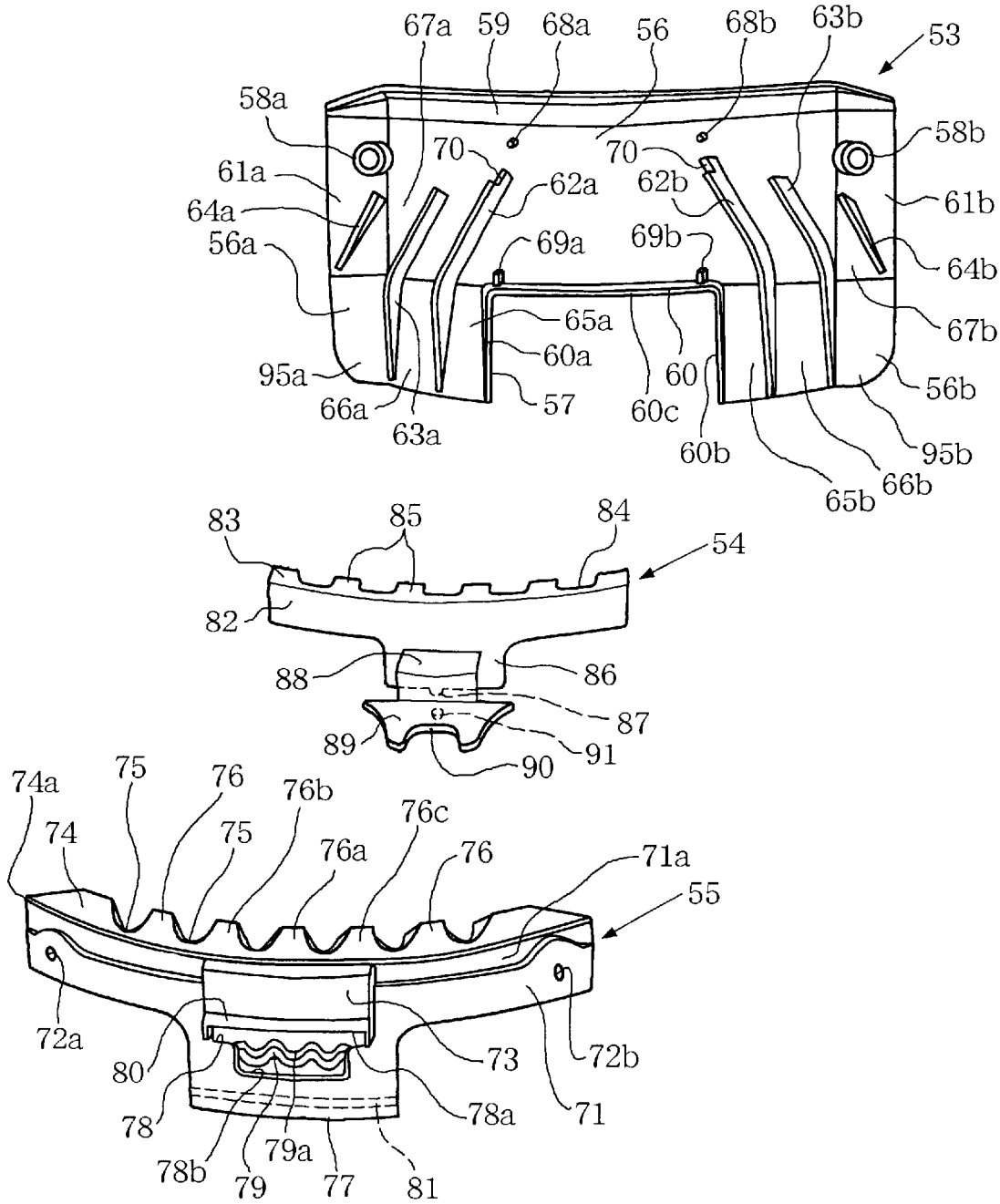
FIG. 4 is an exploded perspective view of the ventilator constituent members of the chin ventilator mechanism shown in FIG. 3.

The chin ventilator mechanism 51 has three types of chin ventilator constituent members consisting of an air supply path forming member 53, a shutter member 54 and an air supply port forming member 55, as shown in FIGS. 3 and 4.

Each of the three types of ventilator constituent members 51 to 53 can be made of a material with appropriate elasticity and appropriate rigidity such as polycarbonate, polyacetal, ABS, nylon, or any other synthetic resin.

As shown in FIGS. 1, 2, 3 and 4, the air supply path forming member 53 has a member main body 56 extending to be curved (a curve protruding outward) substantially arcuately in the horizontal direction substantially along the window opening 13 of the outer shell 11. A substantially square opening 57 is formed at the substantial center of the lower portion of the member main body 56 by notching upward from the lower end. A pair of left and right attaching bosses 58*a* and 58*b* are formed on the front surfaces of the right and left upper portions of the member main body 56. A bend 59 which is bent substantially forward is formed on the upper end of the member main body 56, and an inverted U-shaped bend 60 which is bent substantially forward is formed on the periphery of the opening 57. The left and right sides of the member main body 56 are slightly flexed obliquely forward to form a pair of left and right bends 61*a* and 61*b*. The pair of left and right attaching bosses 58*a* and 58*b* are formed on the upper front surfaces of the pair of left and right bends 61*a* and 61*b*, respectively.

As shown in FIGS. 3 and 4, a plurality of guide plates project from each of the left and right sides of the front surface of the member main body 56 of the air supply path forming member 53. In the embodiment shown in FIGS. 3 and 4, two sets of three different-length guide plates 62*a*, 63*a* and 64*a*, and 62*b*, 63*b* and 64*b* are formed on the left and right sides of the front surface of the member main body 56 such that their lengths gradually decrease from the central side to the left or right side. Left and right side portions 60*a* and 60*b* of the inverted U-shaped bend 60 also serve as guide plates. Hence, three (in other words, a plurality of) left straightening air supply paths 65*a*, 66*a* and 67*a* are formed 1) between the left portion 60*a* of the inverted U-shaped bend 60 and the guide plate 62*a,*
2) between the guide plates 62*a* and 63*a*, and
3) between the guide plates 63*a* and 64*a* on the left side of the front surface of the air supply path forming member 53. Similarly, three (in other words, a plurality of) right straightening air supply paths 65*b*, 66*b* and 67*c* are formed on the right side of the front surface of the air supply path forming member 53. The total number of the straightening air supply paths formed on the air supply path forming member 53 is preferably at least three, and is more preferably at least four.

Of the member main body 56 of the air supply path forming member 53, portions 56*a* and 56*b* located on the left and right sides of the opening 57 (i.e., the lower left and right portions of the member main body 56) are slightly curved to protrude arcuately backward from the upper end to the lower end. A pair of left and right engaged projections 68*a* and 68*b* are formed, near the bend 59, on the member main body 56 of the air supply path forming member 53. Also, engaged plates 69*a* and 69*b* projecting substantially upward are formed near the left and right sides of an upper projecting ridge 60*c* of the inverted U-shaped bend 60.

As shown in FIG. 4, the pair of left and right guide plates 62*a* and 62*b*, which are the longest of the guide plates 62*a* to 64*a* and 62*b* to 64*b*, respectively have steps 70 formed by notching near their upper ends. The steps 70 position and hold the lower end of a member main body 71 of the air supply port forming member 55 (to be described later). As the pair of left and right guide plates 64*a* and 64*b*, which are the shortest, do not extend to the bends 61*a* and 61*b* of the left and right lower portions 56*a* and 56*b* of the member main body 56, the bends 61*a* and 61*b* serve not only as partitioning plates for defining a chin air supply path 121 and chin exhaust paths 122*a* and 122*b*, as will be described later, but also as deflecting plates 95*a* and 95*b* for deflecting the air flow from the central side to the left and right outward.

As shown in FIGS. 1, 2, 3 and 4, the air supply port forming member 55 has the member main body 71 with screw insertion holes 72*a* and 72*b* near its left and right ends and extending to be curved (a curve protruding outward) substantially arcuately in the horizontal direction substantially along the member main body 56 of the air supply path forming member 53. The central portion of the front surface of the member main body 71 projects outward (i.e., toward the front surface), thus forming a projecting surface 73. The inner surface (i.e., the rear surface) of the projecting surface 73 forms a recess. The upper half of the front surface of the member main body 71 is thinner than the lower half thereof and thus forms a thin-walled portion 71*a*. The screw insertion holes 72*a* and 72*b* are formed near the left and right ends of the lower half of the front surface of the member main body 71.

As shown in FIGS. 3 and 4, an inner air supply port forming portion 74 is formed at the upper end of the thin-walled portions 71*a* of the member main body 71 of the air supply port forming member 55 to extend substantially horizontally along the upper end of the thin-walled portions 71*a*, such that it protrudes almost backward to be flexed slightly obliquely upward in the backward direction. The inner air supply port forming portion 74 extends forward to form a projecting ridge 74*a*. As the inner air supply port forming portion 74 has a comb-like shape with a large number of notches 75 formed in its rear end side, a large number of projections 76 are formed between the notches 75. The notches 75 form a plurality of (e.g., three) inner air supply ports on each of the right and left sides. Of the large number of projections 76, a pair of left and right left projections 76*b* and 76*c* which are most adjacent to a central projection 76*a* has engaging holes (not shown), formed in their rear surfaces, to fit on the pair of left and right engaged studs 68*a* and 68*b*, respectively, of the air supply path forming member 53.

As shown in FIG. 4, a substantially U-shaped hanging portion 77 is integrally formed at the central portion of the member main body 71 of the air supply port forming member 55, and accordingly an opening 78 is formed between the member main body 71 and hanging portion 77. Also, a waved spring 79 is integrally formed on the rear surface of the hanging portion 77 across the opening 78 substantially horizontally, and accordingly the opening 78 is halved into an upper and lower openings 78*a* and 78*b*. An inverted U-shaped projecting ridge 80 is formed on the periphery of the upper opening 78*a* along its upper side and left and right sides. A projecting ridge 81 with a groove (not shown) substantially at its center is integrally formed along the lower end of the hanging portion 77 such that it protrudes backward. The spring 79 has a substantially L-shaped longitudinal section and forms a step 79*a* on its outer surface (i.e., front surface).

As shown in FIGS. 3 and 4, the shutter member 54 has a member main body 82 extending to be curved (a curve protruding outward) substantially arcuately in the horizontal direction substantially along the member main body 71 of the air supply port forming member 55. An opening/closing shutter portion 83 is provided to the upper end of member main body 82 of the shutter member 54 to extend substantially horizontally along the upper end of the member main body 82, such that it protrudes almost backward to be flexed slightly obliquely upward in the backward direction. As the opening/closing shutter portion 83 has a comb-like shape and a large number of notches 84 are formed near its rear end to correspond to the notches 75 of the air supply port forming member 55, a large number of projections 85 are formed between the notches 84. The notches 84 form a plurality of (e.g., five) air supply ports, and the projections 85 form a plurality of (e.g., six) blocking portions.

As shown in FIG. 4, a substantially square hanging portion 86, which extends downward, is integrally formed at the substantially central portion of the lower end of the member main body 82 of the shutter member 54. An engaged stud 87 is integrally formed at the substantially central portion of the lower end of the hanging portion 86. A connecting portion 88 with a substantially L-shaped longitudinal section is integrally formed on the hanging portion 86 near the lower end of its front surface. The connecting portion 88 extends substantially horizontally from the hanging portion 86 such that it protrudes almost forward to be flexed slightly obliquely downward in the forward direction, and then substantially vertically such that it protrudes almost downward to be flexed slightly obliquely forward in the downward direction.

A tap 89 is integrally formed on the lower end of the connecting portion 88 of the shutter member 54, as shown in FIG. 4, to extend obliquely forward and downward from this lower end. The tap 89 has a notch 90 at its distal end so the wearer can hold the tap 89 with his fingers easily. A stud 91 is integrally formed on the lower surface of the tap 89, when necessary, so the tap 89 of the shutter member 54 can be slid easily along the outer surface of the outer shell 11.

The three types of chin ventilator constituent members 53 to 55 with the above arrangements are built into the head protecting body 2 on the front surface of the impact-on-the-chin-and-cheek absorbing liner 23, as shown in FIG. 3. For this purpose, as shown in FIGS. 3, 5A and 5B, the front surface of the impact absorbing liner 23 has the inverted U-shaped front recess 45 substantially corresponding to the shape of the air supply path forming member 53. That region of the impact absorbing liner 23 which is surrounded by the front recess 45 forms a fitting projection 92 with the original thickness of the impact absorbing liner 23.

As shown in FIGS. 3, 5A and 5B, the impact-on-the-chin-and-cheek absorbing liner 23 has a comparatively shallow (i.e., shallower than the front recess 45) recess 94 extending substantially horizontally under the front recess 45 and projection 92. The recess 94 is symmetrical (i.e., axi-symmetrical) about the central longitudinal section line 40 shown in FIGS. 5A and 5B as the axis of symmetry, has a substantial T-shape, and reaches the lower end of the impact absorbing liner 23. The left and right portions of the upper end of the recess 94 are continuous to the front recess 45. Hence, rainwater or the like which is to stay in the front recess 45 or at its vicinity is discharged from the lower end of the impact absorbing liner 23 to the outside through the T-shaped recess 94.

As shown in FIGS. 3, 5A and 5B, the impact-on-the-chin-and-cheek absorbing liner 23 has a pair of left and right side recesses or exhaust path recesses 93*a* and 93*b* respectively adjacent to lower left and right portions 45*a* and 45*b* of the front recess 45. The exhaust path recesses 93*a* and 93*b* are continuous to the front recess 45 on the left and right sides of the front recess 45 which are opposite to the central longitudinal section line 40 side (i.e., the lower left and right portions 45*a* and 45*b* of the front recess 45).

The pair of left and right exhaust path recesses 93*a* and 93*b* are symmetrical (i.e., axi-symmetrical) about the central longitudinal section line 40 of FIGS. 5A and 5B as the axis of symmetry. Thus, the left exhaust path recess 93*a* formed in the left half of the impact-on-the-chin-and-cheek absorbing liner 23 will be described in detail with reference to FIGS. 3, 5A and 5B, and a detailed description of the right exhaust path recess 93*b* will be omitted.

The exhaust path recess 93*a* has the exhaust hole 46 serving as its start point (i.e., an air inlet port to the exhaust path recess 93*a*), as shown in FIGS. 5A and 5B. The exhaust path recess 93*a* extends from the exhaust hole 46 to the left (i.e., opposite to the central longitudinal section line 40 side, in other words, horizontally outward or outward to the left and right). An upper surface 101, lower surface 102 and rear surface 103 of the exhaust path recess 93*a* are used to form the chin exhaust path 122*a* (to be described later). The front-side surface (i.e., the front surface) which opposes the rear surface 103 of the exhaust path recess 93*a* is formed by the rear surface of the deflecting/partitioning plate 95*a* of the air supply path forming member 53, as will be described later. Accordingly, the exhaust path recess 93*a* and partitioning plate 95*a* form the chin exhaust path main body that occupies most of the chin exhaust path 122*a* (to be described later). The chin exhaust path 122*a* is comprised of the chin exhaust path main body and that half of the left air supply/exhaust hole 111*a* of the outer shell 11 which is opposite to the central longitudinal section line 40 side (i.e., horizontally outer side).

As shown in FIGS. 5A and 5B, the rear surface (i.e., the bottom surface) 103 of the exhaust path recess 93*a* forms a slant surface slightly slanting backward from the exhaust port 46 to the left (i.e., to the side opposite to the central longitudinal section line 40 side). A slant angle $\theta_1$ of this slant is about 2° in the embodiment shown in FIG. 5B but is generally preferably in the range of 0.5° to 5° from the viewpoint of practicality and is more preferably in the range of 1° to 3°. The front surface (i.e., the outer surface) of the partitioning plate 95*a* which forms a front surface opposing the rear surface 103 of the exhaust path recess 93*a* forms a slant surface, at least near its left end, slanting slightly forward from the exhaust port 46 to the left (i.e., to the side opposite to the central longitudinal section line 40 side). A slant angle $\theta_2$ (not shown) of this slant is about 2° in the embodiment shown in FIGS. 3 and 5B but is generally preferably in the range of 0.5° to 5° in practice and is more preferably in the range of 1° to 3°.

The chin region of the outer shell 11 (i.e., a region opposing the chin of the wearer) has a pair of left and right air supply/exhaust holes 111*a* and 111*b*, as shown in FIGS. 1 and 3. The air supply/exhaust holes 111*a* and 111*b* are long substantially sideways but slant slightly upward from the central longitudinal section line 40 side to the opposite side (i.e., to the left and right outward). The air supply/exhaust holes 111*a* and 111*b* may be covered with dust net or the like when necessary. The halves of the air supply/exhaust holes 111*a* and 111*b* which are on the central longitudinal section line 40 side respectively oppose the left and right lower portions 56*a* and 56*b* of the air supply path forming member 53. The halves (i.e., the other half) of the air supply/exhaust holes 111*a* and 111*b* which are on the sides opposite to the central longitudinal section line 40 side oppose the exhaust path recesses 93*a* and 93*b*. The outer shell 11 has a notch 112 at its substantially central portion, which is notched from the upper end downward, as shown in FIG. 5A. The notch 112 has a size substantially equal to the sum of the sizes of the projecting surface 73 of the air supply port forming member 55, the inverted U-shaped projecting ridge 80 and upper opening 78*a*.

To build the three types of chin ventilator constituent members (i.e., the air supply path forming member 53, the shutter member 54 and the air supply port forming member 55) into the head protecting body 2, the steps described in the following items (i) to (iv) may be sequentially performed.

(i) First, the shutter member 54 is attached to the air supply port forming member 55.

To perform this attaching operation, the tap 89 of the shutter member 54 is inserted in the upper opening 78*a* of the air supply port forming member 55 from the inside toward the outside. After the waved spring 79 rides over the engaged projection 87 of the shutter member 54 from the inner side to the outer side by utilizing the elasticity of the projections 85 of the shutter member 54 and the waved spring 79 of the air supply port forming member 55, the engaged projection 87 is abutted against the step 79*a* of the waved spring 79. In this state, when the shutter member 54 is moved substantially horizontally with respect to the air supply port forming member 55, its engaged projection 87 is fitted in the recess of the waved spring 79 and held in position at three positions, i.e., the central position and the left and right positions. The substantially horizontal movement of the shutter member 54 is regulated as the connecting portion 88 abuts against the left and right surfaces of the upper opening 78*a* of the air supply path forming member 53.

(ii) The air supply port forming member 55 attached with the shutter member 54 is temporarily attached to the air supply path forming member 53.

To perform this attaching operation, the engaged projections 68*a* and 68*b* of the air supply path forming member 53 are fitted in the engaging holes formed in the rear surfaces of the projections 76*b* and 76*c* of the air supply port forming member 55. In this case, when necessary, the projections 76*b* and 76*c* or the peripheries of the engaging holes may be coated with an adhesive, so the engaged projections 68*a* and 68*b* and the engaging holes can be connected to each other comparatively reliably and firmly. Simultaneously, the upper projecting ridge 60*c* of the air supply path forming member 53 is relatively fitted in the groove of the bend 81 of the air supply port forming member 55.

(iii) The air supply path forming member 53 attached with the shutter member 54 is attached to the inner surface of the chin region of the outer shell 11.

To perform this attaching operation, as shown in FIG. 5A, attaching screws (not shown) may be inserted in a pair of left and right screw insertion holes 113, formed on the outer shell 11, from the outer surface to the inner surface, then in the pair of left and right screw insertion holes 72*a* and 72*b* of the air supply port forming member 55, and may be screwed into the pair of left and right attaching bosses 58*a* and 58*b* of the air supply path forming member 53. In this case, the projecting surface 73 and inverted U-shaped projecting ridge 80 of the air supply port forming member 55 are inserted in the notch 112 of the outer shell 11, and the lower portion and tap 89 of the connecting portion 88 of the shutter member 54 project forward from the notch 112. The member main body 71 (excluding the thin-walled portions 71*a*), the projecting ridge 74*a* and the hanging portion 77 of the air supply port forming member 55, and the inverted U-shaped bend 60, those sides of the pair of left and right bends 61*a* and 61*b*, which are opposite to the central longitudinal section line 40 side, and lower ends of the left and right lower portions 56*a* and 56*b* (further including the entire or part of the upper ends of the guide plates 62*a* to 64*a* and 62*b* to 64*b* depending on the case) of the air supply path forming member 53 abut against the inner surface of the outer shell 11. As shown in FIG. 3, the left and right lower portions 56*a* and 56*b* of the member main body 56 of the air supply path forming member 53 respectively oppose those halves of the pair of left and right air supply/exhaust holes 111*a* and 111*b*, which are on the central longitudinal section line 40 side, of the outer shell 11.

(iv) The outer surface of the impact-on-the-chin-and-cheek absorbing liner 23 is abutted against the inner surface of the outer shell 11 and attached to it with an adhesive or the like.

This attaching operation is performed such that the fitting projection 92 of the impact-on-the-chin-and-cheek absorbing liner 23 is fitted in the fitting opening 57 of the air supply path forming member 53, as shown in FIG. 3, and such that the almost or substantially entire air supply path forming member 53 is relatively fitted in the front recess 45 of the impact absorbing liner 23. As a result, as shown in FIG. 3, the pair of left and right exhaust path recesses 93*a* and 93*b* of the impact absorbing liner 23 respectively oppose those halves of the pair of left and right air supply/exhaust holes 111*a* and 111*b*, which are opposite to the central longitudinal section line 40 side, of the outer shell 11. In this case, as shown in FIGS. 1 and 2, a conventionally known breath guard 114 may be interposed between the outer surface (i.e., the front surface) of the impact-on-the-chin-and-cheek absorbing liner 23, and the inner surfaces (i.e., rear surfaces) of the outer shell 11 and air supply path forming member 53, thereby attaching the breath guard 114 to the head protecting body 2.

Through the steps described in the above items (i) to (iv), the three types of chin ventilator constituent members 53 to 55 can be built in the head protecting body 2. In the built-in state, the chin ventilator mechanism 51 has the chin air supply path 121 and the pair of left and right chin exhaust paths 122*a* and 122*b* (to be described later).

The chin air supply path 121 is sequentially comprised of 1) those halves of the pair of left and right air supply/exhaust holes 111*a* and 111*b*, which are on the central longitudinal section line 40 side, of the outer shell 11,
2) a pair of left and right (i.e., two) gaps defined by the outer surfaces of the left and right lower portions 56*a* and 56*b* of the air supply path forming member 53 and the inner surface of the outer shell 11 and including the lower portions of the straightening air supply paths 65*a* to 67*a* and 65*b* to 67*b*,
3) one gap defined by the outer surface of the air supply path forming member 53, the inner surface of the air supply port forming member 55 and the inner surface of the shutter member 54, and including the upper portions of the straightening air supply paths 65*a* to 67*a* and 65*b* to 67*b*, and
4) the notches 84 of the shutter member 54 and the notches 75 of the air supply port forming member 55 from its start point (i.e., the air inlet port to the chin air supply path 121) to its end point (i.e., the air outlet port from the chin air supply path 121). The start point of the chin air supply path 121 is formed by the outer surfaces of those halves of the pair of left and right air supply/exhaust holes 111*a* and 111*b*, which are on the central longitudinal section line 40 side, of the outer shell 11. These outer surfaces form the air inlet port to the chin air supply path 121. The end point of the chin air supply path 121 is formed by the upper ends of the notches 75 of the air supply port forming member 55. These upper ends form the air outlet port from the chin air supply path 121. Hence, the chin air supply path 121 branches into two branches from the end point toward the start point. The three gaps described in the above items 2) and 3) respectively form air supply gaps. Accordingly, the three types of chin ventilator constituent members 53 to 55 and the chin region of the outer shell 11 make up the chin air supply path main body that occupies most of the chin air supply path 121. The chin air supply path 121 is comprised of the chin air supply path main body and one halve of the air supply/exhaust hole 111*a* described in the item 1).

When the wearer wearing the full-face-type helmet 1 drives a motor cycle, outer air (i.e., external air) flows relatively from the substantially front surface into the air supply/exhaust holes 111*a* and 111*b* described in the item 1). Hence, those halves of the air supply/exhaust holes 111*a* and 111*b*, which are on the central longitudinal section line 40 side, serve as the air supply hole portions of the chin air supply path 121. The external air flows from the notches 84 and 75 described in the item 4) to near the lower end of the inner surface of the shield plate 4 through the two gaps described in the item 2) and one gap described in the item 3), as shown in FIGS. 2 and 3. Therefore, the external air can be introduced into the head protecting body 2 through the chin air supply path 121. The external air is straightened by the straightening air supply paths 65*a* to 67*a* and 65*b* to 67*b* while it flows upward in the three gaps described in the items 2) and 3). The external air flowing to near the lower end of the inner surface of the shield plate 4 (i.e., above the substantially central portion of the impact-on-the-chin-and-cheek absorbing liner 23 and above the breath guard 114) shifts upward along the inner surface of the shield plate 4 to reach near the upper end of the inner surface of the shield plate 4. As a result, the external air flow can effectively prevent the shield plate 4 from being fogged by the breath exhaled by the wearer.

The chin air supply path 121 can be blocked by operating the shutter member 54. More specifically, when the engaged projection 87 of the shutter member 54 engages with the central one of the three engaging recesses of the waved spring 79, the projections (i.e., the blocking portions) 85 of the shutter member 54 block the notches (i.e., air outlet ports) 75 of the air supply port forming member 55. When the wearer holds the tap 89 of the shutter member 54 and moves the shutter member 54 to the left or right so the engaged projection 87 of the shutter member 54 engages with another engaging recess, other than the central one, of the waved spring 79, the projections 85 of the shutter member 54 are displaced from the notches 75 of the air supply port forming member 55 to substantially overlie on the projections 76. Hence, the air outlet ports 75 of the air supply port forming member 55 are opened. Therefore, when the wearer operates the shutter member 54 to engage the engaged projection 87 with the central engaging recess of the waved spring 79, the chin air supply path 121 can be blocked so air supply through it can be stopped.

The pair of left and right chin exhaust paths 122*a* and 122*b* are symmetrical (i.e., axi-symmetrical) about the central longitudinal section line 40 shown in FIGS. 5A and 5B as the axis of symmetry. Hence, the left chin exhaust path 122*a* will be described in detail with reference to FIGS. 3, 4, 5A and 5B, and a detailed description on the right chin exhaust path 122*b* will be omitted.

The left chin exhaust path 122*a* is sequentially comprised of 1) the exhaust port 46 of the left half of the impact-on-the-chin-and-cheek absorbing liner 23,
2) the space surrounded by the upper, lower and rear surfaces 101, 102 and 103 of the exhaust path recess 93*a* of the left half of the impact-on-the-chin-and-cheek absorbing liner 23 and the defecting/partitioning plate 95*a* of the left half of the air supply path forming member 53, and
3) that half (i.e., the other half) of the air supply/exhaust hole 111*a*, which is opposite to the central longitudinal section line 40 side, of the outer shell 11 from its start point (i.e., the air inlet port to the chin exhaust path 122*a*) to its end point (i.e., the air outlet port from the chin exhaust path 122*a*). The start point of the left chin exhaust path 122*a* is formed by the inner surface of the exhaust port 46 of the left half of the impact absorbing liner 23. This inner surface forms the air inlet port to the left chin exhaust path 122*a*. The end point of the left chin exhaust path 122*a* is formed of the outer surface of that half of the air supply/exhaust hole 111*a*, which is opposite to the central longitudinal section line 40 side, of the outer shell 11. This outer surface forms the air outlet port from the left exhaust path 122*a*. The space described in the item 2) forms an exhaust gap.

When the wearer wearing the full-face-type helmet 1 drives a motor cycle, as described above, the external air flows relatively from the substantially front surface into the other half of the air supply/exhaust hole 111*a* described in the item 3). Simultaneously, the external air abutting against near the central portion of the chin region of the outer surface of the outer shell 11 is deflected horizontally outward (i.e., from the central longitudinal section line 40 side to the left opposite to it) along the outer surface of the outer shell 11, and flows backward. In this case, the external air flowing relatively from the substantially front surface into the other half of the air supply/exhaust hole 111*a* described in the item 3) is blocked by the front surface 103 of the exhaust path recess 93*a* in the left half of the impact-on-the-chin-and-cheek absorbing liner 23 (in this case, the slant angle $\theta_1$ of this front surface 103 functions or a negative pressure is produced as will be described later), and is deflected horizontally outward. Also, of the external air deflected horizontally outward along the outer surface of the outer shell 11, external air flowing to that half of the air supply/exhaust hole 111*a* described in item 3), which is on the central longitudinal section line 40 side, is deflected horizontally outward by the deflecting plate 95*a* described in the item 2), as shown in FIG. 3. Hence, this external air flows out from that half of the air supply/exhaust hole 111*a* described in the item 3), which is on the central longitudinal section line 40 side, and flows away horizontally outward in front of the other half of the air supply/exhaust hole 111*a* along the outer surface of the outer shell 11. This produces the negative pressure near the outer end of the exhaust path recess 93*a* and near the other half of the air supply/exhaust hole 111*a* described in the item 3).

Air in the impact-on-the-chin-and-cheek absorbing liner 23, below the breath guard 114 and near the exhaust hole 46 described in the item 1) (i.e., internal air including breath exhaled by the wearer and near the intermediate position in the vertical direction of the chin region of the impact absorbing liner 23) flows into this exhaust hole 46, reaches the other half of the air supply/exhaust hole 111*a* described in the item 3) through the space described in the item 2), and flows out of the outer shell 11 from this other half. Hence, that half of the air supply/exhaust hole 111*a*, which is opposite to the central longitudinal section line 40 side, serves as the exhaust hole portion of the chin exhaust path 122*a*. Since air in the head protecting body 2 can be exhausted to the outside through the chin exhaust path 122*a*, the shield plate 4 can be prevented further effectively from being fogged by the breath exhaled by the wearer or the like.

(3) Description on Head Ventilator Mechanism 52

As shown in FIGS. 2 and 6, the head ventilator mechanism 52 has one or a plurality of (in the embodiment shown in FIGS. 2 and 6, a pair of left and right) ventilation grooves 131 extending substantially semicircularly from the front end to the rear end (in other words, from the front head region to the nape region through the top head region and back head region) through the substantially central portion, in the right-to-left direction, of the inner surface (i.e., inner circumferential surface) of the impact-on-the-head absorbing liner 21. The ventilation grooves 131 serve as head air paths, and are wide from their start points to near the front head region and narrow from there to the top head region. The head ventilator mechanism 52 has the backing cover 22 covering almost or substantially the entire inner surface of the impact-on-the-head absorbing liner 21, as described above. The backing cover 22 has a large number of ventilation openings 141. The ventilation openings 141 serve as air supply openings or exhaust openings depending on their positions or how the helmet is used (i.e., the open/closed states of shutter members 143 and 145 to be described later). The head ventilator mechanism 52 is comprised of a forehead ventilator portion 132, front head ventilator portion 133, back head ventilator portion 134 and nape ventilator portion 135 respectively formed along the ventilation grooves 131. Hence, in the following description, the forehead ventilator portion 132, front head ventilator portion 133, back head ventilator portion 134 and nape ventilator portion 135 will be described in separate items with reference to FIGS. 2 and 6.

(i) Description on Forehead Ventilator Portion 132

As described above, the forehead ventilator portion 132 has the ventilation openings 31 formed in the front-side engaged member 25 of the backing cover 22 and the ventilation openings 32 formed in the front-side engaged member 27 of the impact-on-the-head absorbing liner 21. The ventilation openings 31 are continuous to the ventilation grooves 131 through the ventilation openings 32.

Hence, as described above, the external air introduced into the head protecting body 2 through the chin air supply path 121 and reaching near the upper end of the inner surface of the shield plate 4 flows into the ventilation grooves 131 through the ventilation openings 31 and 32, and flows toward the front head ventilator portion 133 through the ventilation grooves 131.

(ii) Description on Front Head Ventilator Portion 133

The front head ventilator portion 133 has a pair of left and right air supply hole forming members 142 attached to the outer shell 11, and the shutter members 143 respectively attached to the air supply hole forming members 142. Thus, the pairs of left and right air supply hole forming members 142 and shutter members 143 correspond to the pair of left and right air supply/exhaust holes 111*a* and 111*b* in items of design, as shown in FIG. 1. The front head regions of the outer shell 11 and the impact-on-the-head absorbing liner 21 respectively have air supply holes. The air supply holes formed in the outer shell 11 fit on cylindrical air supply hole portions 142*a* of the air supply hole forming members 142. The air supply holes formed in the front head region of the impact-on-the-head absorbing liner 21 are continuous to the ventilation grooves 131, and oppose the ventilation openings 141 formed in the backing cover 22 through the ventilation grooves 131. Also, the shutter members 143 are slidably attached to the air supply hole forming members 142 such that they can selectively open and close the outer ends of the air supply hole portions 142*a* of the air supply hole forming members 142.

When the shutter members 143 are open, the first air flow flowing through the ventilation grooves 131 from the forehead region toward the front head region of the head protecting body 2 merges with the second air flow flowing from the outside into the ventilation grooves 131 through the air supply hole portions 142*a*. When the shutter members 143 are closed, the first air flow further flows as a single flow toward the back head region through the ventilation grooves 131. When the first and second air flows merge, part of the merged air (mainly the second air flow portion) flows into the interior of the head protecting body 2 near the front head region through the ventilation openings 141 of the backing cover 22.

(iii) Description on Back Head Ventilator Portion 134

The back head ventilator portion 134 has a pair of left and right exhaust hole forming members 144 attached to the outer shell 11, and the shutter members 145 respectively attached to the exhaust hole forming members 144. Thus, the pairs of left and right exhaust hole forming members 144 and shutter members 145 correspond to the pairs of left and right air supply hole forming members 142 and shutter members 143, and air supply/exhaust holes 111*a* and 111*b* in terms of design, as shown in FIG. 1. This makes the outer shell 11 look simple. The back head regions of the outer shell 11 and impact-on-the-head absorbing liner 21 respectively have exhaust holes. The exhaust holes formed in the outer shell 11 fit on cylindrical exhaust holes 144*a* of the exhaust hole forming members 144. The exhaust holes formed in the back head region of the impact-on-the-head absorbing liner 21 are continuous to the ventilation grooves 131, and oppose the ventilation openings 141 formed in the backing cover 22 through the ventilation grooves 131. Also, the shutter members 145 are slidably attached to the exhaust hole forming members 144 such that they can selectively open and close the outer ends of the exhaust holes 144*a* of the exhaust hole forming members 144.

When the shutter members 145 are open, the first air flow flowing through the ventilation grooves 131 from the front head region toward the back head region of the head protecting body 2 slightly merges with the second air flow flowing out from the inside of the backing cover 22 through the ventilation grooves 131 and exhaust holes 144*a*. When the shutter members 145 are closed, the first air flow further flows substantially entirely toward the back head region through the ventilation ridge grooves 131.

(iv) Description on Nape Ventilator Portion 135

The nape ventilator portion 135 is shown in enlargement in FIG. 6. Referring to FIG. 6, the main body portion of the backing cover 22 is formed of porous nonwoven fabric 147 to which appropriate-shaped elastic blocks 146 made of a flexible elastic material such as urethane foam or another synthetic resin are attached with an adhesive or the like. The rear-side engaged member 26 is attached to the main body portion, which is on the elastic blocks 146 side, as described above. The ventilation openings 33 of the rear-side engaged member 26 are continuous to the ventilation grooves 131 through the ventilation openings 34 of the rear-side engaging member 28 of the impact-on-the-head absorbing liner 21.

An exhaust port forming member 151 is attached to the lower end face of the rear portion of the impact-on-the-head absorbing liner 21 with a tape, adhesive, or the like. The exhaust port forming member 151 is comprised of a base plate portion 151*a* which forms the lower end face of the rear portion of the head protecting body 2, and a pair of left and right exhaust ports 151*b* formed by expanding part of a pair of left and right portions of the base plate portion 151*a* like bags such that their longitudinal sections form almost triangular shapes. Each exhaust port 151*b* has a large number of slit-like inner exhaust holes 152 formed in a wall portion in front of the exhaust port 151*b*, and an outer exhaust hole 153 formed by boring the lower end of the exhaust port 151*b* entirely. The outer exhaust holes 153 are continuous to the ventilation grooves 131 through the inner exhaust holes 152. Hence, the outer ends of the outer exhaust holes 153 form the end points (i.e., air outlet ports) of the ventilation grooves (i.e., head air paths) 131.

The outer shell 11 has a narrow or constricted portion 11*a* in the outer surface of the nape region at its rear portion to extend substantially horizontally. In the embodiment shown in FIG. 6, the constricted portion 11*a* is narrowed or constricted forward by about 9 mm (about 10 mm from the lower end of the rear portion of the lower rim member 12), from the lower end of the rear portion of the outer shell 11, on the center line in the right-to-left direction of the outer shell 11. The radius of curvature of the constricted portion 11*a* on this center line is about 15 mm. For this reason, that portion of the outer shell 11 (and accordingly the lower rim member 12) which is near the lower end of its rear portion slants downward from above in the backward direction on the center line, as shown in FIG. 6. A slant angle $\theta_3$ of this slant is about 30°. The constricted portion 11*a* is constricted the most on the center line of the rear portion of the outer shell 11, and is constricted less forward along the left or right side. The constricted portion 11*a* has a length in the back-and-forth direction of as large as about 50 mm, and a length in the right-to-left direction of as large as about 16 cm. The impact-on-the-head absorbing liner 21 also has a narrow or constricted portion 21*a* in the same manner as the outer shell 11. The constricted portion 21*a* is substantially in tight contact with the constricted portion 11*a* of the outer shell 11.

Hence, the air flow flowing relatively along the rear portion of the outer surface of the outer shell 11 is deflected by the constricted portion 11*a* sharply backward, so a portion near under the outer exhaust holes 153 of the exhaust port forming member 151 becomes a negative pressure. Thus, the first air flow flowing through the ventilation grooves 131 toward the nape region, and the second air flow flowing from the interior of the head protecting body 2 into the ventilation grooves 131 through the large number of clearances of the porous nonwoven fabric 147, the ventilation openings 33 of the rear-side engaged member 26, and the ventilation openings 34 of the rear-side engaging member 28 flow out from the outer exhaust holes 153 effectively through the inner exhaust holes 152 of the exhaust port forming member 151. Thus, the air flow in the ventilation grooves 131 can be improved by the nape ventilator portion 135.

The constricted portion 11*a* generally preferably satisfies one or more of the conditions described in the following items 1) to 5) in practice:

1) the constricted portion 11*a* should be constricted forward by 4 mm to 16 mm (more preferably by 6 mm to 12 mm) from the lower end of the rear portion of the outer shell 11, or by 5 mm to 17 mm (more preferably by 7 mm to 13 mm) from the lower end of the rear portion of the lower rim member 12, on the center line in the right-to-left direction of the outer shell 11;
2) the radius of curvature on this center line should be in the range of 6 mm to 25 mm (more preferably 10 mm to 20 mm);
3) that portion of the outer shell 11 or lower rim member 12 which is near the lower end of its rear portion should slant downward from above in the backward direction on the center line in the range of 20° to 40° (more preferably 25° to 35°) (in other words, the slant angle $\theta_3$ should be in the range of 20° to 40° (more preferably 25° to 35°));
4) the length in the back-and-forth direction should be in the range of 25 mm to 100 mm (more preferably 35 mm to 75 mm); and
5) the length in the right-to-left direction should be in the range of 8 cm to 32 cm (more preferably 12 cm to 24 cm).

Having described a specific preferred embodiment of this invention with reference to the accompanying drawings, it is to be understood that the invention is not limited to that precise embodiment, and that various changes and modifications may be effected therein by one skilled in the art without departing from the scope or spirit of the invention as defined in the appended claims.

In the above embodiment, the chin air supply path 121 of the chin ventilator mechanism 51 is comprised of the air supply/exhaust holes 111*a* and 111*b* of the outer shell 11 and three types of chin ventilator constituent members 53 to 55, and the chin exhaust paths 122*a* and 122*b* of the chin ventilator mechanism 51 are comprised of the air supply/exhaust holes 111*a* and 111*b* of the outer shell 11, the exhaust holes 46 and exhaust path recesses 93*a* and 93*b* of the impact-on-the-chin-and-cheek absorbing liner 23, and the deflecting/partitioning plates 95*a* and 95*b* of the air supply path forming member 53. Alternatively, the chin exhaust paths 122*a* and 122*b* may be comprised of, e.g., a separate pair of left and right tublar chin ventilator constituent members and air supply/exhaust holes 111*a* and 111*b* of the outer shell 11.

In the above embodiment, the pair of left and right air supply/exhaust holes 111*a* and 111*b* are formed in the chin region of the outer shell 11, and the center-side halves of the air supply/exhaust holes 111*a* and 111*b* form air supply hole portions while other halves thereof opposite to the center side form exhaust hole portions. However, the present invention does not necessary have this arrangement. For example, one air supply/exhaust hole may be formed at the substantial center in the right-to-left direction of the chin region of the outer shell 11, the substantially central portion of this air supply/exhaust hole may be used as an air supply hole portion, and those portions of this supply/exhaust hole which correspond to the left and right sides of the air supply hole portion may be used as a pair of left and right exhaust hole portions.

In the above embodiment, the opening/closing shutter portion 83 of the shutter member 54 slides along the lower surface of the inner air supply port forming portion 74 of the air supply port forming member 55. Alternatively, the opening/closing shutter portion 83 may slide along the upper surface of the inner air supply port forming portion 74.

In the above embodiment, the ventilation grooves 131 with open loop-like longitudinal sections are formed in the inner surface of the head protecting body 2 in order to form head air paths. Alternatively, in place of the ventilation grooves 131 with the open loop-like longitudinal sections, closed loop-like elongated holes with circular longitudinal sections may be formed. In this case, the impact-on-the-head absorbing liner 21 may be halved into an outer liner portion on the outer shell 11 side and an inner liner portion opposite to the outer shell 11 side, and opposing grooves with open loop-like longitudinal sections may be formed in the inner surface of the outer liner portion and the outer surface of the inner liner portion. This pair of grooves can form elongated ventilation holes with closed loop-like longitudinal sections.

In the above embodiment, the present invention is applied to the chin ventilator mechanism 51. The present invention can also be applied to other mechanisms or portions such as the front head ventilator portion 133 of the head ventilator mechanism 52.

In the above embodiment, the present invention is applied to the full-face-type helmet 1. Alternatively, the present invention can also be applied to helmets of other types, i.e., a jet- or semijet-type helmet, or a full-face-type helmet serving also as a jet-type helmet, the chin portion of which can be raised.

What is claimed is:

1. A helmet comprising a head protecting body with an outer shell, wherein an air supply path for introducing air outside said outer shell into said head protecting body is formed in said head protecting body, an exhaust path for exhausting air in the head protecting body outside said outer shell is formed in said head protecting body apart from said air supply path, and an air supply/exhaust hole serving as a hole to be shared by an air supply hole portion for said air supply path and an exhaust hole portion for said exhaust path is formed in said outer shell.

2. A helmet according to claim 1, wherein one half of said air supply/exhaust hole, which is on a central side of said helmet in a horizontal direction, forms said air supply hole portion for said air supply path, and the other half of said air supply/exhaust hole, which is opposite to said central side of said helmet in the horizontal direction, forms said exhaust hole portion for said exhaust path.

3. A helmet according to claim 1, wherein an air supply path main body which forms said air supply path together with said air supply hole portion of said air supply/exhaust hole, and an air supply path forming member used for forming said air supply path main body is disposed on an inner surface of a chin region of said outer shell.

4. A helmet according to claim 3, wherein said air supply path forming member has at least three straightening air supply paths.

5. A helmet according to claim 3, wherein said air supply path forming member has at least fourth straightening air supply paths.

6. A helmet according to claim 3, wherein an air supply port forming member with an inner air supply port forming portion is arranged between said outer shell and said air supply path forming member.

7. A helmet according to claim 6, wherein a shutter member for opening/closing a ventilation port of said inner air supply port forming portion is provided to said air supply port forming member.

8. A helmet according to claim 3, which comprises an exhaust path main body for constituting said exhaust path together with said exhaust hole portion of said air supply/exhaust hole, and an impact absorbing liner arranged inside said outer shell, wherein said exhaust path main body comprises a recess formed in an outer surface of said impact absorbing liner, an aperture formed in said impact absorbing liner to be continuous to said recess, and a partitioning plate of said air supply path forming member.

9. A helmet according to claim 8, wherein a bottom surface of said recess forms a slant surface slanting backward toward that side of said helmet which is opposite to a central longitudinal section line side, and said slant surface has a slant angle within a range of 0.5° to 5°.

10. A helmet according to claim 9, wherein the slant angle is within a range of 1° to 3°.

11. A helmet according to claim 8, wherein at least part of that portion of an outer surface of said partitioning plate, which forms said exhaust path main body, forms a slant surface slanting forward toward that side of said helmet which is opposite to the central longitudinal section line side, and said slant surface has a slant angle within a range of 0.5° to 5°.

12. A helmet according to claim 11, wherein the slant angle is within a range of 1° to 3°.

13. A helmet according to claim 1, wherein said air supply/exhaust hole comprises a pair of left and right air supply/exhaust holes in said chin region of said outer shell, said air supply path is formed at a substantially central portion in a horizontal direction of said chin region of said head protecting body, said exhaust path comprises a pair of left and right exhaust paths on left and right portions of said chin region of said head protecting body, those halves of said pair of left and right air supply/exhaust holes, which are on said central side in the horizontal direction, form air supply hole portions for said air supply path, and those halves of said pair of left and right air supply/exhaust hole, which are opposite to the central side in the horizontal direction, form exhaust hole portions for said pair of left and right exhaust paths.

14. A helmet according to claim 13, wherein said air supply path branches into two branches from an end point to a start end thereof.

15. A helmet according to claim 14, wherein a fitting opening is formed at a center of a lower portion of said air supply path forming member by notching upward from a lower end of said air supply path forming member, and a fitting projection is formed on said impact absorbing liner, said fitting projection being fitted in said fitting opening.

16. A helmet according to claim 13, wherein an air outlet port which forms an end point of a head air path is formed in a lower end face of a rear portion of said head protecting body, and a constricted portion is formed in a rear portion of said outer shell.

17. A helmet according to claim 16, wherein a slant angle of said constricted portion near a lower end of said rear portion of said outer shell is in a range of 20° to 40° on a center line in a right-to-left direction of said outer shell.

18. A helmet according to claim 17, wherein the slant angle of said constricted portion near said lower end of said rear portion of said outer shell is in a range of 25° to 35° on the center line in the right-to-left direction of said outer shell.

* * * * *